United States Patent [19]

Lawrence

[11] Patent Number: 4,573,536

[45] Date of Patent: Mar. 4, 1986

[54] METHOD AND APPARATUS FOR FLUSHING A WELL

[75] Inventor: James D. Lawrence, Conroe, Tex.

[73] Assignee: Dailey Petroleum Services Corporation, Conroe, Tex.

[21] Appl. No.: 654,770

[22] Filed: Nov. 7, 1984

[51] Int. Cl.[4] ..... E21B 34/14; E21B 21/10

[52] U.S. Cl. ..... 166/373; 166/330; 166/178; 175/306

[58] Field of Search ..... 175/311, 317, 312, 293, 175/298, 299, 304–306, 300, 332, 238; 166/330, 332, 334, 178, 373, 416–418, 415; 251/15, 24, 344, 230; 173/80, 78

[56] References Cited

U.S. PATENT DOCUMENTS

| | | | |
|---|---|---|---|
| 2,815,925 | 12/1957 | Fisher, Jr. | 166/330 |
| 3,208,541 | 9/1965 | Lawrence | 175/299 |
| 3,209,834 | 10/1965 | Essary | 166/311 X |
| 3,233,690 | 2/1966 | Lawrence | 175/320 X |
| 3,735,827 | 5/1973 | Berryman | 166/178 X |
| 4,059,167 | 11/1977 | Berrymann | 175/297 |
| 4,161,224 | 7/1979 | Hostrup | 166/178 X |
| 4,162,691 | 7/1979 | Perkins | 166/312 X |
| 4,460,041 | 7/1984 | Berrymann | 166/134 |

*Primary Examiner*—Stephen J. Novosad
*Assistant Examiner*—David J. Bagnell
*Attorney, Agent, or Firm*—Arnold, White & Durkee

[57] ABSTRACT

A method and apparatus for flushing a well involves the use of a tool which enables a certain jarring displacement to cause a flush valve to be opened. Rotary oscillation of a stem in a given direction may be converted by a ratchet mechanism into rotation of a sleeve in the same direction. The stem may oscillate in either of two rotary directions but rotation in only one direction is transferred to the sleeve. In addition, the ratchet mechanism may be arranged so that rotation of the stem by a given amount results in rotation of the sleeve by a lesser amount. The rotation of the sleeve may be converted into a reciprocating motion of a valve portion through a cam-like engagement between the sleeve and the valve portion. The valve portion includes a port which is capable of communicating with a port in the barrel in response to a predetermined extent of displacement along the longitudinal axis of a drill string. Thus, the ratchet mechanism may be arranged so that a given number of rotary movements of the stem are required in order to achieve communication between the ports in the barrel and the valve portion. The stem may be connected to a jar mechanism, advantageously a rotary mechanical jar, so that jarring and flushing actuations may be interrelated. The arrangement of the flush valve and its operating structure enables continuous communication through the region of the drill string bore proximate to the flush valve and the ratchet mechanism, regardless of the state of the valve.

12 Claims, 5 Drawing Figures

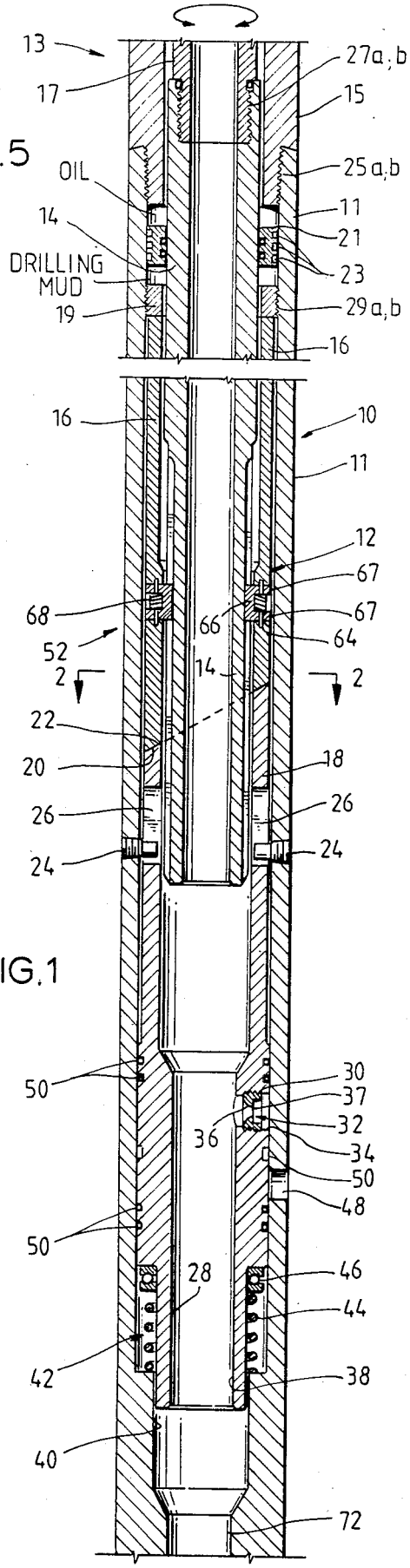
FIG.5
FIG.1
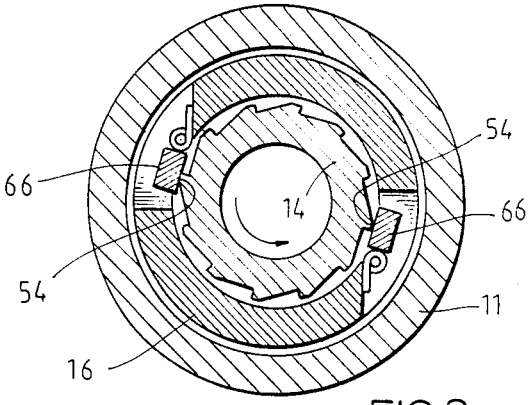
FIG.3
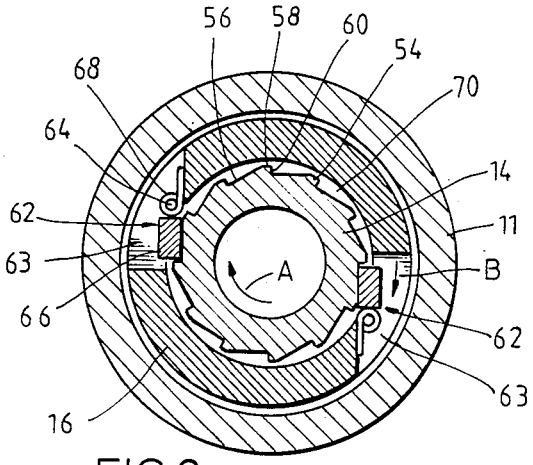
FIG.2
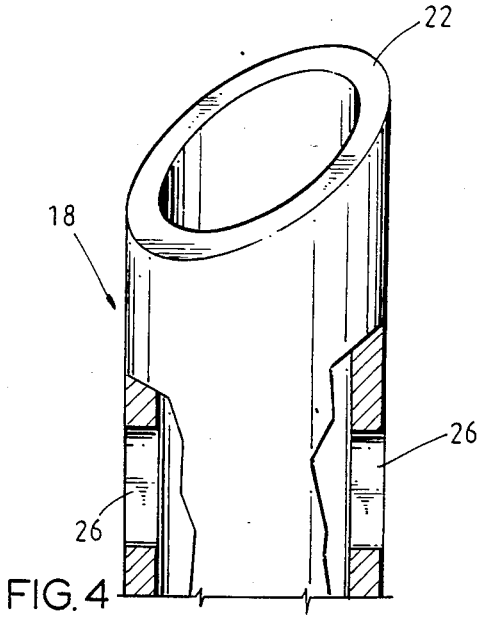
FIG.4

METHOD AND APPARATUS FOR FLUSHING A WELL

BACKGROUND OF THE INVENTION

1. Field of the Invention

This invention relates generally to drilling oil and gas wells and particularly to methods and apparatus for flushing wells.

2. Brief Description of the Background Art

In the drilling and production of oil and gas wells, adverse conditions may arise which cause the drill string to become stuck. For example, the formation of key seats in the wall of the well bore, the caving in of the formation or the settling of drilling mud or cuttings may require time consuming wash over or fishing operations before the well can be completed.

Many drill strings include a jarring mechanism to aid in the prevention of drill string sticking and the release of the drill string upon the occurrence of sticking. By the employment of a mechanism of this kind, it is often possible to quickly release the string in the event of sticking or to loosen a broken or disconnected portion of a drill pipe or other object which has become stuck in the well.

It is also well known to use a flush valve to selectively flush the return annulus of the drill hole to help free the string during jarring. Flushing may be used during a fishing job to retrieve junk from the hole. A surge of water rushing towards the drill bit helps to free a stuck drill string or to clear junk for grappling and removal.

The operation of conventional drilling flush valves may disrupt the normal operation of the drilling string. In conventional flush valves the bore of the drill string is interrupted or "clogged" to operate the valve. For example, in one conventional flush valve, a ball is dropped into the string to shear a pin to open the flush valve. As a result the bore cannot thereafter be fully utilized as channel for communication with the region of the string at or below the valve area. After a flush valve is operated it may be desirable to run a "free point" indicator through the bore to determine where, if anywhere, the string is stuck. In addition, it may be desirable to run various tools or instruments by wireline or otherwise through the bore, past the flush valve. Moreover, in conventional flush valves it may not be possible to close the valve after it has been opened, without removing the string from the hole. Thus, for these reasons, it must be appreciated that the operation of such valves may severely interrupt the normal operation of the string.

SUMMARY OF THE INVENTION

It is a primary object of the present invention to provide a flushing apparatus and method that lessens the interruption of normal drilling operations occasioned by flush valve actuation.

It is another object of the present invention to provide such a method and apparatus that enables continued communication through the string bore with the regions of the string at or below the flush valve regardless of the state of flush valve operation.

It is also an object of the present invention to provide a downhole method and apparatus for automatically flushing a well in conjunction with a jarring operation.

It is another object of the present invention to provide such a flushing method and apparatus involving flushing the well after a given number of displacements of the drill string.

It is yet another object of the present invention to provide such a method and apparatus which involves the conversion of rotary displacements into reciprocating motion to operate a flush valve.

It is also an object of the present invention to provide such a method and apparatus which converts two-way rotary oscillation into reciprocation to operate a flush valve.

These and other objects of the present invention may be accomplished by a flushing apparatus for a drill string with an elongate central bore. A remotely operable tubular mechanism has a central bore and is arranged to maintain fluid communication through the drill string bore. A tubular flush valve is operatively connected to the mechanism. The valve includes a central bore arranged to maintain fluid communication through the drill string bore.

In accordance with another embodiment of the present invention a flushing apparatus includes a mechanism connectable to a jar. A flush valve is operatively connected to the mechanism to cause a flushing action in response to the operation of the jar. The apparatus may include a hollow barrel and a hollow sleeve concentrically contained within the barrel. A hollow stem is concentrically contained within the sleeve and is connectable on its upper end to a source of rotary motion. The mechanism may be located between the stem and the sleeve to transfer rotary displacement in only one direction from the stem to the sleeve and to convert rotary displacement of the stem into longitudinal translation of the sleeve with respect to the barrel. The flush valve may then be operatively connected to the mechanism.

In accordance with another embodiment of the present invention, a method of flushing a well includes the step of jarring a drill string. The jarring motion is converted into a motion suitable for operating a flush valve. The flush valve operating motion is connected to the flush valve to cause automatic flushing of the well in concert with the jarring. The flush valve may then be automatically operated after a given number of jars. Rotary jarring motion in two directions may be converted into rotation in only one direction and longitudinal translation. Thereafter, the translation is used to open a flush valve to cause flushing of the well bore.

BRIEF DESCRIPTION OF THE DRAWING

FIG. 1 is a partial, vertical cross-sectional view taken through one embodiment of the present invention;

FIG. 2 is an enlarged cross-sectional view taken generally along the line 2—2 in FIG. 1;

FIG. 3 is an enlarged cross-sectional view taken generally along the line 2—2 in FIG. 1 when the stem is rotated to a different position from the position shown in FIG. 2;

FIG. 4 is an enlarged, partial, partially sectioned perspective view of the lower portion of the sleeve shown in FIG. 1; and FIG. 5 is a partial, vertical cross-sectional view depicting the connection between the top end of the embodiment shown in FIG. 1 and a drilling jar.

DESCRIPTION OF A PREFERRED EMBODIMENT

Referring to the drawing wherein like reference characters are used for like parts throughout the several views, a part of a drill string 10, shown in FIG. 1, includes an outer, hollow barrel 11, an inner, hollow, concentric sleeve 12, and an innermost, hollow concentric stem 14. For example, in the conventional fashion, the portion of the string 10 shown in FIG. 1 may connect to an upper portion of the drill string 10 including a jarring sub (not shown) and may connect on the lower end to a drilling collar (not shown) that mounts a drilling bit (not shown).

The sleeve 12 is free to rotate around the longitudinal axis of the barrel 11 with respect to the barrel 11 and stem 14. Similarly, the stem 14 is free to rotate around the same axis with respect to the sleeve 12. While the barrel 11 conventionally extends for the entire length of the drill string 10, the sleeve 12 is considerably shorter, as indicated in FIG. 1, and the stem 14, while longer than the sleeve 12, is still shorter than the barrel 11.

The sleeve 12 includes the discrete upper actuator portion 16 and lower valve portion 18. The portions 16 and 18 have generally the same inside and outside diameters but abut along opposed, bevelled faces 20 and 22, as shown in FIGS. 1 and 4.

While the upper portion 16 is free to rotate around the longitudinal axis with respect to the barrel 11 and stem 14, rotation of the lower portion 18 with respect to the barrel 11 is prevented by the pins 24 which extend radially inwardly from their mountings within the barrel 11. Each pin 24 rides within a longitudinally aligned slot 26 in the lower portion 18. Thus, the lower portion 18 is capable of up and down reciprocation but is not capable of rotary motion around the longitudinal axis.

The lower portion 18 also includes a reduced internal diameter section 28 receiving a plurality of equally circumferentially spaced, radially aligned, removable nozzles 30 each having a central aperture 32. Each nozzle 30 is threadedly secured within an opening within the reduced diameter section 28. The apertures 32 have a generally disc-shaped region 34 closest the outside diameter of the section 28, a generally inwardly diverging funnel-shaped region 36 nearest the inside diameter of the section 28, and a central venturi section 37.

In FIG. 5 the upper portion of the drill string 10 of FIG. 1 is shown connected to the lower portion of a drilling jar 13. The lower portion of the drilling jar 13 includes a hollow barrel 15, a hollow concentric stem 17, a retainer nut 19, a floater 21, and packings 23. The inside diameter of the hollow barrel 11 has at its top mating threads 25*a*. The mating threads 25*a* mate with mating threads 25*b* at the bottom of the outside diameter of the hollow barrel 15 of the drilling jar. The inside diameter of the hollow concentric stem 14 has at its top mating threads 27*a*. The mating threads 27*a* mate with mating threads 27*b* at the bottom of the outside diameter of the hollow concentric stem 17 of the drilling jar.

The upper portion of the sleeve 12 comprises an upper actuator portion 16. Abutting the top of the upper actuator portion 16 is the retainer nut 19. The outside diameter of the retainer nut 19 has mating threads 29*a*. The mating threads 29*a* mate with the mating threads 29*b* on the inside diameter of the hollow barrel 11. The floater 21, typically made of brass, has packings 23, typically comprising rubber O-rings, which press against the inside diameter of the hollow barrel 11 and the outside diameter of the hollow concentric stem 14 and thus act as seals to keep the oil above the floater from descending, and to keep the drilling mud below the floater from ascending.

A reduced outside diameter tube 38 extends from the lower end of the lower portion 18. The tube 38 telescopically mates with a reduced inside diameter passageway 40 formed in the barrel 11 so that relative telescopic reciprocation is possible between the tube 38 and the barrel 11. An annular chamber 42 defined between the tube 38 and the barrel 11 holds a coiled spring 44. At the upper end of the spring 44 is an annular thrust bearing 46 arranged to slide between the spring 44 and the tube 38.

As shown in FIG. 1, a plurality of generally equally circumferentially spaced apertures 48 are positioned within the barrel 11 just below the normal position of the sleeve 12. In the illustrated embodiment three apertures 48, spaced apart by 120°, are arranged to mate with three nozzles 30. The normal position of the sleeve 12 is achieved when the coiled spring 44 is compressed only by the weight of the sleeve 12 and not by any additional downward pressure. In this configuration, the apertures 32 and 48 are fluidically isolated from one another by the annular seals 50 which are mounted on the lower portion 18.

An actuator 52 is positioned between the barrel 11 and the stem 14. As shown in FIG. 2, the exterior surface of the stem 14 includes a plurality of peripheral, longitudinally extending, ramp-shaped teeth 54, each including an inclined side 56, a tangentially oriented top 58 and a radially aligned edge 60. In the illustrated embodiment, twelve teeth 54 are utilized. A pair of opposed ratchet mechanisms 62 are held within the slots 63 in the upper portion 16 by way of longitudinally oriented spring rods 64. Each rod 64 mounts a ratchet block 55 for rotation about the axis of the rod 64. A torsion spring 68, encircling each rod 64, is located generally between the rod 64 and the ratchet block 66. One end of the torsion spring 68 is fixed to the ratchet block 66 while the other end is fixed to the sleeve 12. Each block 66 includes a pair of ears 67 that encircle a rod 64. As a result, rotation of each ratchet block 66 with respect to the sleeve 12 is resisted by a spring 68 so that the ratchet block 66 normally attempts to engage a groove 70 between adjacent teeth 54 in the stem 14.

Thus, in response to rotation of the stem 14 in a clockwise direction, as indicated by the arrow A in FIG. 2, the sleeve 12 is rotated in the same direction, as indicated by the arrow B. This is because each ratchet block 66 engages a groove 70 and radially aligned edge 60 of a tooth 54, so that the radially aligned edge 60 of an adjacent tooth 54 pushes the ratchet blocks 66 and connected sleeve 12 in the same direction as the stem 14 is rotating. However, when the stem 14 rotates in the opposite direction, as indicated by the arrow in FIG. 3, the ratchet blocks 66 are cammed outwardly by the inclined sides 56 of the adjacent teeth 54 so that no rotation is communicated from the stem 14 to the sleeve 12.

In one particularly advantageous embodiment of the present invention, the stem 14 is connected to a rotary jar mechanism such as the mechanism disclosed in U.S. Pat. Nos. 3,233,690 and 3,208,541 to R. R. Lawrence, both patents hereby expressly incorporated by reference herein. Briefly, in the incorporated patents, a rotary, mechanical jar is disclosed which is operable in response to an upward or downward force applied to a drill string. For example, in response to an upward pull on the string, the spring tension on coiled springs is overcome to allow relative rotation between a barrel and mandrel in a direction to cause a plurality of rollers to roll out of J-shaped notches into longitudinal grooves whereupon the mandrel is suddenly moved upwardly with a snapping action. The upward movement of the mandrel continues until the mandrel engages the upper end of an anvil to deliver an upward impact. After the jar has been operated to exert such an upward impact, the upward pull on the string may be reduced to allow the mandrel to move downwardly in the barrel, whereupon the rollers again enter the notches to latch the jar preparatory to another actuation. Thus, operation of the jar results in back and forth rotary oscillation of the mandrel. By connecting the mandrel to the stem 14, the stem 14 is rotated in the same direction and by the same amount as the mandrel portion of the jar when the string is jarred.

When the stem 14 rotates in a counterclockwise direction, as shown in FIG. 3, the rotary motion is not transferred to the sleeve 12. This motion could correspond, for example, to the jarring actuation. Then when the jar mandrel returns to a position wherein the rollers are engaged within the notches preparatory to the next jarring operation, the mandrel may rotate in a clockwise direction rotating the stem 14 in the clockwise direction, as indicated in FIG. 2. With this direction of rotation, the rotation of the mandrel is transferred through the stem 14 to the sleeve 12 so that the sleeve 12 rotates by almost the same amount as the stem 14. There may be a slight difference in the degree of rotation between the stem 14 and the sleeve 12 because of the arrangement of the teeth 54 and grooves 70. Specifically, a slight rotation of the stem 14 is normally required before each ratchet block 66 engages the radially aligned edge 60 of a tooth 54. Thus, the larger angle of rotation of the stem 14 is converted into a smaller angle of rotation of the sleeve 12.

The rotation of the sleeve 12 under the driving force of the ratchet blocks 66 also results in relative rotation of the upper portion 16 with respect to the lower portion 18. This relative motion occurs between the opposed bevelled faces 20 and 22. Specifically, the bevelled configuration of the faces 20 and 22 results in linear reciprocating action of the lower portion 18 in response to rotary motion of the upper portion 16. In effect, the upper portion 16 cams the lower portion 18 downwardly against the bias supplied by the spring 44 when the portion 16 rotates in a clockwise direction, as indicated in FIG. 2. The arrangement of the pins 24 within the slots 26 in the lower portion 18 ensures that only longitudinal reciprocation of the lower portion 18 is possible in response to rotation of the upper portion 16.

Advantageously, each rotation of the stem 14 does not sufficiently displace the sleeve 12 and its reduced internal diameter section 28 to cause alignment between the apertures 32 and 48. Instead, each rotation of the stem 14 advantageously only displaces the nozzles 30 a single increment closer to the apertures 48 in the barrel 11. In this way, a number of rotary actuations of the sleeve 12 are required to achieve communication between the apertures 32 and 48. Furthermore, a greater number of jars, advantageously about twice as many, may be required to implement the second and subsequent flushes than were required to achieve the first flush.

In an embodiment wherein the stem 14 is connected to or integral with the mandrel of a rotatively released jar, such as the jar described in the patents incorporated herein by reference, each time the mandrel returns to a position wherein the rollers are re-engaged in the notches, the stem 14 is rotated, for example in a clockwise direction, resulting in the simultaneous, similar rotation of the sleeve 12. However, the arc of rotation of the sleeve 12 is slightly less than the arc of rotation of the stem 14.

In one preferred embodiment, each time the stem 14 oscillates through an arc of 36°, the sleeve 12, which is rotated by the twelve teeth 54, each of which makes up 30° of circumference, may rotate 30°. Moreover, in such an embodiment, with every four to six jars, communication between the apertures 32 and 48 is achieved while the actuator 52 is reset to its initial position, illustrated in FIG. 1, by six to eight additional jars. Thus, the second flush occurs after about ten to fourteen additional jars.

When the stem 14 rotates in a counterclockwise direction, no rotation is transmitted to the sleeve 12. Thus, the rachet blocks 66 are cammed outwardly and the stem 14 rotates to a position wherein the edges 60 of adjacent teeth 54 are spaced from the blocks 66. Thus, in an embodiment using a jar of the type described in the patents incorporated herein by reference, the sleeve 12 may be advanced only in response to returning actuations of the mandrel and not in response to jarring actuations. Of course, the opposite effect could be achieved, by a reversal of parts, so that the sleeve 12 is advanced only in response to jarring actuations of the mandrel. The sleeve 12 is continuously advanced in the same direction around a longitudinal axis with each successive jar. In effect the back and forth rotation of the jarring mandrel is converted into a continuously incremented step-wise rotation of a sleeve 12 wherein the extent of rotation of the sleeve 12 is somewhat less than the extent of rotation of the stem 14. This is because the initial portion of the clockwise rotation is consumed in closing the gap between the edges 60 and the blocks 66.

Each time the apertures 32 and 48 come into fluid communication, fluid, such as drilling mud, contained within the string bore 72 is allowed to rush outwardly into the well bore and upwardly along the sides of the string 10. This flushing operation acts in conjunction with the jarring actuation to help free a stuck drill string. By delaying the flushing operation so that it occurs only after a number of jarring actuations, flushing occurs automatically only at the most advantageous time, after several jars. However, the operator may produce a flushing action whenever desired, by simply implementing the required number of jars to produce a flush.

After a flushing actuation has occurred, repeated actuation of the jar progressively moves the lower portion 18 upwardly with respect to the barrel 11 causing the apertures 32 and 48 to be isolated from one another. As the upper portion 16 turns, the lower portion 18 is pushed upwardly by the spring 44. After a predetermined number of jars, the apertures 32 and 48 are then realigned.

With the present invention flush valve operation may be accomplished without interrupting or clogging the drill string bore 72. This enables continued communication through the bore 72 to the regions of the string at the level of and below the flush valve, during and after flushing. As a result various tools and instruments, such as a "free point" indicator for indicating any points where the string is stuck, may be lowered through the flush valve regardless of its open or closed state. Moreover, the flush valve may be opened or closed as desired without necessitating tripping out of the hole.

While the present invention has been described with respect to a single preferred embodiment, those skilled in the art will appreciate a number of modifications and variations and it is intended within the appended claims to cover all such variations and modifications as come within the true spirit and scope of the present invention.

What is claimed is:

1. A flushing apparatus for a drill string with an elongate central bore, said apparatus comprising:

a remotely operable tubular mechanism, said mechanism having a central bore and being arranged to maintain fluid communication through said drill string bore, said mechanism including a hollow barrel, a hollow stem concentrically contained within said barrel, a hollow stem concentrically contained within said sleeve and connectable on its upper end to a source of rotary motion, and a rachet device adapted to transfer rotary motion in one direction between said sleeve and said stem and to free-wheel in response to rotary motion in the opposite direction; and a tubular flush valve operatively connected to said mechanism, said valve including a central bore and being arranged to maintain fluid communication through said drill string bore.

2. The apparatus of claim 1 wherein said sleeve includes a tubular portion and said mechanism further includes a cam means for converting rotation of said sleeve into reciprocation of said tubular portion with respect to said barrel.

3. The apparatus of claim 2 wherein said tubular portion and said sleeve have bevelled abutting surfaces.

4. The apparatus of claim 3 wherein said valve includes an opening in said barrel and an opening in said tubular portion such that said valve opens when said openings are aligned in response to translation of said tubular portion with respect to said barrel.

5. A well flushing apparatus comprising:

a mechanism connectable to a jar, said mechanism including a hollow barrel, a hollow sleeve concentrically contained within said barrel, a hollow stem concentrically contained within said sleeve and connectable on its upper end to a source of rotary motion, and a rachet device adapted to transfer rotary motion in one direction between said sleeve and said stem and to free-wheel in response to rotary motion in the opposite direction; and a flush valve operatively connected to said mechanism to cause a flushing action in response to the operation of said jar.

6. The apparatus of claim 5 wherein said sleeve includes a tubular portion and said mechanism further includes a cam means for converting rotation of said sleeve into reciprocation of said tubular portion with respect to said barrel.

7. The apparatus of claim 6 wherein said tubular portion and said sleeve have bevelled abutting surfaces.

8. The apparatus of claim 7 wherein said valve includes an opening in said barrel and an opening in said tubular portion such that said valve opens when said openings are aligned in response to translation of said tubular portion with respect to said barrel.

9. A method of flushing a well comprising the steps of:

jarring the string;

converting the jarring motion into a motion suitable for operating a flush valve, wherein said converting involves converting rotary jarring motion in either of two directions into rotary motion in only one direction; and connecting said flush valve operating motion to a flush valve to cause automatic flushing of the well in concert with said jarring.

10. The method of claim 9 including the step of converting the rotary motion in only one direction into a rotary movement of a smaller angular extent.

11. The method of claim 10 including the step of flushing after a given number of jars and flushing again after a number of jars which is greater than the number of jars required to achieve the previous flush.

12. The method of claim 11 including the step of flushing a first time after from four to six jars and flushing again after from ten to fourteen jars.

* * * * *

UNITED STATES PATENT AND TRADEMARK OFFICE

CERTIFICATE OF CORRECTION

PATENT NO. : 4,573,536

DATED : March 4, 1986

INVENTOR(S) : James D. Lawrence

It is certified that error appears in the above—identified patent and that said Letters Patent is hereby corrected as shown below:

Column 7, line 21, "stem" should be --sleeve--;

Column 8, line 34, "automatic flushing of the well" should be --opening of said flush valve--.

Signed and Sealed this

*Seventeenth* Day of *June 1986*

[SEAL]

*Attest:*

DONALD J. QUIGG

*Attesting Officer*

*Commissioner of Patents and Trademarks*